US011261657B1

(12) United States Patent
Wan

(10) Patent No.: US 11,261,657 B1
(45) Date of Patent: Mar. 1, 2022

(54) WINDOW BLIND

(71) Applicant: Wuxi JHT Homewares Co., Ltd., Wuxi (CN)

(72) Inventor: Yong Wan, Wuxi (CN)

(73) Assignee: WUXI JHT HOMEWARES CO., LTD., Wuxi (CN)

( * ) Notice: Subject to any disclaimer, the term of this patent is extended or adjusted under 35 U.S.C. 154(b) by 0 days.

(21) Appl. No.: 17/160,317

(22) Filed: Jan. 27, 2021

(30) Foreign Application Priority Data

Nov. 25, 2020 (CN) ..... 202022769285.9

(51) Int. Cl.
*E06B 9/42* (2006.01)

(52) U.S. Cl.
CPC ..... *E06B 9/42* (2013.01)

(58) Field of Classification Search
CPC ..... E06B 9/24; E06B 9/26; E06B 9/42
See application file for complete search history.

(56) References Cited

U.S. PATENT DOCUMENTS 4,557,309 A * 12/1985 Judkins ..... E06B 9/262 160/279
4,733,711 A * 3/1988 Schon ..... E06B 9/262 160/279
4,762,159 A * 8/1988 Ford ..... E06B 9/262 160/279
4,852,627 A * 8/1989 Peterson ..... E06B 9/262 160/84.02
5,839,494 A * 11/1998 Judkins ..... E06B 9/262 160/167 R
6,644,373 B2 * 11/2003 Palmer ..... E06B 9/322 160/168.1 R
10,428,899 B2 * 10/2019 Wei ..... F16F 9/125
2017/0016274 A1 * 1/2017 Zheng ..... E06B 9/304

FOREIGN PATENT DOCUMENTS

DE 102011053648 A1 * 3/2013 ..... E06B 9/262
EP 1526245 A1 * 4/2005 ..... E06B 9/327

* cited by examiner

*Primary Examiner* — Beth A Stephan
(74) *Attorney, Agent, or Firm* — Matthias Scholl P.C.; Matthias Scholl

(57) ABSTRACT

A window blind includes an upper beam, a plurality of foldable slats, a lower beam, a fastener, a spring, a movable base, a fixed base, a first wheel set, a second wheel set, and a third wheel set. The upper beam includes a lower part and a slideway. The plurality of foldable slats is fastened to the lower part of the upper beam and includes a lower part. The lower beam is fastened to the lower part of the plurality of foldable slats. The fastener, the spring, the movable base, and the fixed base are disposed between the upper beam and the plurality of foldable slats. The fastener and the fixed base are fixed on the upper beam. The movable base is disposed in the slideway. The spring includes two ends. The fastener includes a first hook and the movable base includes a second hook.

6 Claims, 2 Drawing Sheets

WINDOW BLIND

CROSS-REFERENCE TO RELAYED APPLICATIONS

Pursuant to 35 U.S.C. § 119 and the Paris Convention Treaty, this application claims foreign priority to Chinese Patent Application No. 202022769285.9 filed on Nov. 25, 2020, the contents of which, including any intervening amendments thereto, are incorporated herein by reference. Inquiries from the public to applicants or assignees concerning this document or the related applications should be directed to: Matthias Scholl PC., Attn.: Dr. Matthias Scholl Esq., 245 First Street, 18th Floor, Cambridge, Mass. 02142.

BACKGROUND

The disclosure relates to the field of window treatment, and more particularly to a window blind.

Conventionally, the opening and closing of the window blinds is manually controlled through a rope. The rope is easy to produce marks on the hand or hurts the hand.

In recent years, cordless window blinds have been developed. Typically, the cordless window blinds include an upper beam, a middle beam, a lower beam, a plurality of foldable slats disposed between the middle beam and the lower beam, and a plurality of winding devices. The plurality of winding devices each includes at least one spring. The window blinds close owing to the gravity of the middle beam and the lower beam, and lifts up through the elastic force of the springs of the plurality of winding devices. In this way, the springs are in a tensile state for long, and thus are easy to lose elasticity. In addition, the winding devices lead to high manufacturing costs.

SUMMARY

The disclosure provides a window blind comprising an upper beam, a plurality of foldable slats, a lower beam, a fastener, a spring, a movable base, a fixed base, a first wheel set, a second wheel set, and a third wheel set. The upper beam comprises a lower part and a slideway. The plurality of foldable slats is fastened to the lower part of the upper beam and comprises a lower part. The lower beam is fastened to the lower part of the plurality of foldable slats. The fastener, the spring, the movable base, and the fixed base are disposed between the upper beam and the plurality of foldable slats; the fastener and the fixed base are fixed on the upper beam; the movable base is disposed in the slideway; the spring comprises two ends; the fastener comprises a first hook and the movable base comprises a second hook; the two ends of the spring are connected to the first hook and the second hook, respectively; each of the first wheel set, the second wheel set, and the third wheel set comprises a first wheel and a second wheel; the first wheels of the first wheel set, the second wheel set, and the third wheel set are disposed on the fixed base and second wheels of the first wheel set, the second wheel set, and the third wheel set are disposed on the movable base; the first wheels and the second wheels are disposed in a line; the distances between the two wheels of the first wheel set, between the two wheels of the second wheel set, and between the two wheels of the third wheel set are dwindling; the first wheel set, the second wheel set, and the third wheel set are connected to each other via a coil; the coil comprises a first end fixed on the fixed base, and a second end extending to wind around the first wheel set, the second wheel set, and the third wheel set; the second end comprises a first strand and a second strand; and the upper beam comprises two through holes which are spaced apart, and the first strand and the second strand respectively pass through the two through holes and are fixed on the lower beam.

In a class of this embodiment, the movable base comprises a side wall and a sliding wing disposed on the side wall; and the sliding wing is slidably disposed in the slideway of the upper beam.

In a class of this embodiment, the lower end of the upper beam and the upper end of the lower beam each comprise a connection end, and the connection end comprises a narrow strip hole.

In a class of this embodiment, the radiuses of the first wheel set, the second wheel set, and the third wheel set are dwindling; two wheels of each of the first wheel set, the second wheel set, and the third wheel set are symmetrically disposed on the movable base and the fixed base, respectively.

In a class of this embodiment, the lower end of the lower beam comprises a lifting lug.

In a class of this embodiment, the upper end and the lower end of the plurality of foldable slats both comprise hard material including not limited to wood, plastic and metal; the upper end of the plurality of foldable slats is disposed in the narrow strip hole of the upper beam, and the lower end of the plurality of foldable slats is disposed in the narrow strip hole of the lower beam; two ends of the upper beam and the lower beam are equipped with side covers configured to limit the plurality of foldable slats to move in a direction parallel to the upper/lower beam.

The following advantages are associated with the window blind of the disclosure:

1. The window blind omits a middle beam of a conventional window blind, thus reducing the weight of the window blind and saving the manufacturing costs.

2. The coil is wound around the first wheel set, the second wheel set, and the third wheel set thus ensuring the friction therebetween. The friction and the elastic force of the spring are balanced so as to close or lift up the plurality of foldable slats under the action of an external force. Even if the elastic force is weakened, owing to the friction force between the coil and the wheel sets, the plurality of foldable slats can be opened and closed conveniently and stably, thus extending the service life of the window blind.

3. The lower end of the upper beam and the upper end of the lower beam each are provided with a connection end. The connection end comprises a narrow strip hole. The upper end and the lower end of the plurality of foldable slats are made of hard material including not limited to wood, plastic and metal. The upper end of the plurality of foldable slats is inserted in the narrow strip hole of the upper beam, and the lower end of the plurality of foldable slats is inserted in the narrow strip hole of the lower beam.

Two ends of the upper beam and the lower beam are equipped with side covers configured to limit the plurality of foldable slats to move in a direction parallel to the upper/lower beam. When the side covers are removed, and the plurality of foldable slats can be dismounted for cleaning and maintenance.

Figure 1:
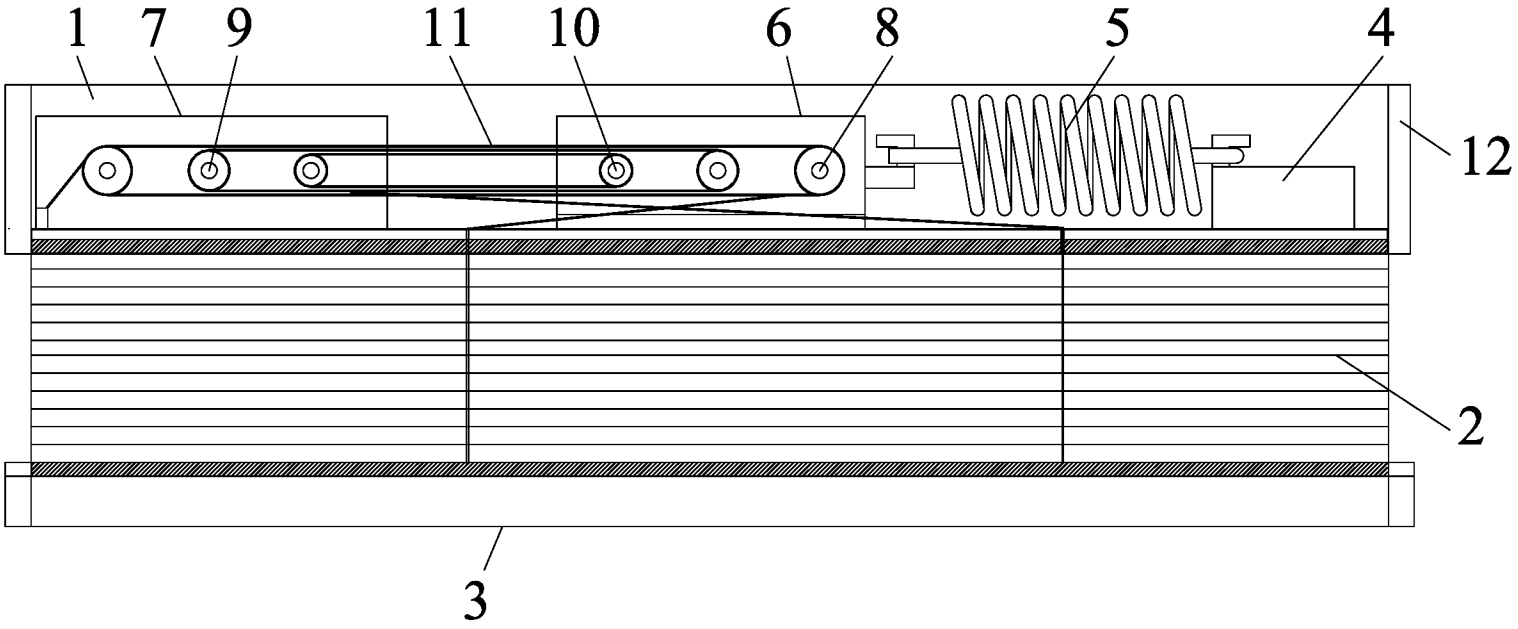
FIG. 1 is a sectional view of a window blind in accordance with one embodiment of the disclosure.

In the drawings, the following reference numbers are used: 1. Upper beam; 2. Foldable slat; 3. Lower beam; 4. Fastener; 5. Spring; 6. Movable base; 7. Fixed base; 8. First wheel set; 9. Second wheel set; 10. Third wheel set; 11. Coil; 12. Side cover.

DETAILED DESCRIPTION

To further illustrate, embodiments detailing a window blind are described below. It should be noted that the following embodiments are intended to describe and not to limit the disclosure.

Figure 2:
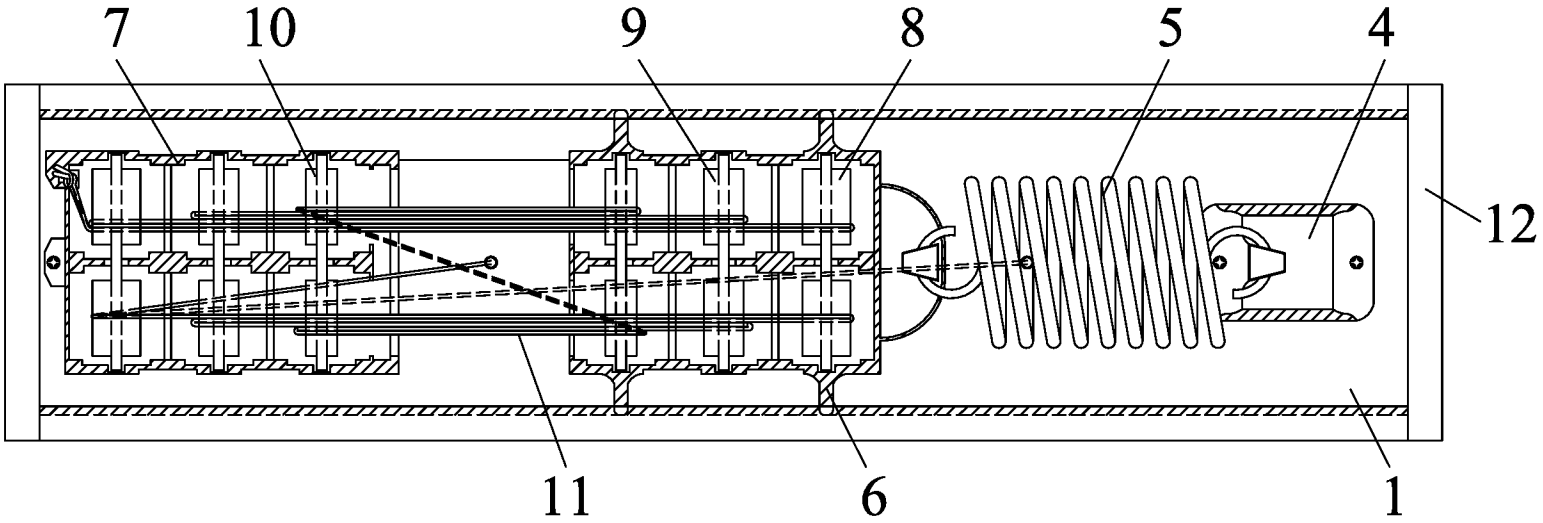
FIG. 2 is a top view of a window blind in accordance with one embodiment of the disclosure.

As shown in FIGS. 1-2, the disclosure provides a window blind comprising an upper beam 1, a plurality of foldable slats 2 fastened to the lower part of the upper beam 1, a lower beam 3 fastened to the lower part of the plurality of foldable slats 2, a fastener 4, a spring 5, a movable base 6, a fixed base 7, a first wheel set 8, a second wheel set 9, and a third wheel set 10. The fastener 4, the spring 5, the movable base 6, and the fixed base 7 are disposed between the upper beam 1 and the plurality of foldable slats 2. The fastener 4 and the fixed base 7 are fixed on the upper beam 1. The upper beam 1 comprises a slideway and the movable base 6 is disposed in the slideway. The spring 5 comprises two ends. The fastener 4 comprises a first hook and the movable base 6 comprises a second hook. The two ends of the spring 5 are connected to the first hook and the second hook, respectively. Each of the first wheel set 8, the second wheel set 9, and the third wheel set 10 comprises a first wheel and a second wheel. The first wheels of the first wheel set 8, the second wheel set 9, and the third wheel set 10 are disposed on the fixed base 7 and the second wheels of the first wheel set 8, the second wheel set 9, and the third wheel set 10 are disposed on the movable base 6. The first wheels and the second wheels are disposed in a line. The distances between the two wheels of the first wheel set 8, between the two wheels of the second wheel set 9, and between the two wheels of the third wheel set 10 are dwindling. The first wheel set 8, the second wheel set 9, and the third wheel set 10 are connected to each other via a coil 11. The coil 11 comprises a first end fixed on the fixed base 7, and a second end extending to wind around the first wheel set 8, the second wheel set 9, and the third wheel set 10. The second end comprises a first strand and a second strand. The upper beam 1 comprises two through holes which are spaced apart and the first strand and the second strand respectively pass through the two through holes and are fixed on the lower beam 3.

The window blind of the disclosure omits an intermediate beam, thus reducing the weight of the window blind and saving the manufacturing costs. The coil 11 is wound around the first wheel set 8, the second wheel set 9, and the third wheel set 10 thus ensuring the friction therebetween. The friction and the elastic force of the spring 5 are balanced so as to close or lift up the plurality of foldable slats 2 under the action of an external force. Even if the elastic force is weakened, owing to the friction force between the coil 11 and the wheel sets, the plurality of foldable slats 2 can be opened and closed conveniently and stably, thus extending the service life of the window blind.

As shown in FIG. 1, the movable base 6 comprises a side wall and a sliding wing disposed on the side wall. The sliding wing is slidably disposed in the slideway of the upper beam 1. In this way, when the movable base 6 is slidable, it will not fall off from the upper beam 1, thus improving the working stability of the movable base.

As shown in FIG. 2, the lower end of the upper beam 1 and the upper end of the lower beam 3 each are provided with a connection end. The connection end comprises a narrow strip hole. The upper end and the lower end of the plurality of foldable slats 2 are made of hard material including not limited to wood, plastic and metal. The upper end of the plurality of foldable slats 2 is inserted in the narrow strip hole of the upper beam 1, and the lower end of the plurality of foldable slats 2 is inserted in the narrow strip hole of the lower beam 3. Two ends of the upper beam 1 and the lower beam 3 are equipped with side covers 12 configured to limit the plurality of foldable slats 2 to move in a direction parallel to the upper/lower beam. When the side covers 12 are removed, and the plurality of foldable slats 2 can be dismounted for cleaning and maintenance.

As shown in FIGS. 1 and 2, the radiuses of the first wheel set 8, the second wheel set 9, and the third wheel set 10 are dwindling. Two wheels of each of the first wheel set 8, the second wheel set 9, and the third wheel set 10 are symmetrically disposed on the movable base 6 and the fixed base 7, respectively, which is conducive to the winding of the coil, and thus prevent the entanglement of the coil.

In this embodiment, the lower end of the lower beam 3 comprises a lifting lug. Pulling the lifting lug, and the lower beam 3 moves downward whereby the plurality of slats 2 is unfolded.

It will be obvious to those skilled in the art that changes and modifications may be made, and therefore, the aim in the appended claims is to cover all such changes and modifications.

What is claimed is:

1. A device, comprising:

an upper beam comprising a lower part and a slideway;

a plurality of foldable slats fastened to the lower part of the upper beam and comprising a lower part;

a lower beam fastened to the lower part of the plurality of foldable slats;

a fastener;

a spring;

a movable base;

a fixed base;

a first wheel set;

a second wheel set; and a third wheel set;

wherein the fastener, the spring, the movable base, and the fixed base are disposed between the upper beam and the plurality of foldable slats;

the fastener and the fixed base are fixed on the upper beam;

the movable base is disposed in the slideway;

the spring comprises two ends;

the fastener comprises a first hook and the movable base comprises a second hook;

the two ends of the spring are connected to the first hook and the second hook, respectively;

each of the first wheel set, the second wheel set, and the third wheel set comprises a first wheel and a second wheel;

the first wheels of the first wheel set, the second wheel set, and the third wheel set are disposed on the fixed base and second wheels of the first wheel set, the second wheel set, and the third wheel set are disposed on the movable base;

the first wheels and the second wheels are disposed in a line;

distances between the two wheels of the first wheel set, between the two wheels of the second wheel set, and between the two wheels of the third wheel set are dwindling;

the first wheel set, the second wheel set, and the third wheel set are connected to each other via a coil;

the coil comprises a first end fixed on the fixed base, and a second end extending to wind around the first wheel set, the second wheel set, and the third wheel set;

the second end comprises a first strand and a second strand; and the upper beam comprises two through holes which are spaced apart, and the first strand and the second strand respectively pass through the two through holes and are fixed on the lower beam.

2. The device of claim 1, wherein the movable base comprises a side wall and a sliding wing disposed on the side wall; and the sliding wing is slidably disposed in the slideway of the upper beam.

3. The device of claim 1, wherein a lower end of the upper beam and an upper end of the lower beam each comprise a connection end, and the connection end comprises a narrow strip hole.

4. The device of claim 1, wherein radiuses of the first wheel set, the second wheel set, and the third wheel set are dwindling; two wheels of each of the first wheel set, the second wheel set, and the third wheel set are symmetrically disposed on the movable base and the fixed base, respectively.

5. The device of claim 1, wherein a lower end of the lower beam comprises a lifting lug.

6. The device of claim 1, wherein an upper end and a lower end of the plurality of foldable slats both comprise hard material including but not limit to wood, plastic and metal; the upper end of the plurality of foldable slats is disposed in the narrow strip hole of the upper beam, and the lower end of the plurality of foldable slats is disposed in the narrow strip hole of the lower beam; two ends of the upper beam and the lower beam are equipped with side covers configured to limit the plurality of foldable slats to move in a direction parallel to the upper/lower beam.

* * * * *